US009579659B2

(12) United States Patent
Starr et al.

(10) Patent No.: US 9,579,659 B2
(45) Date of Patent: Feb. 28, 2017

(54) CLASSIFIER

(71) Applicant: FLSmidth A/S, Valby (DK)

(72) Inventors: David Starr, Forest Lake (AU); Taavi Orupold, Woolloongabba (AU)

(73) Assignee: FLSmidth A/S (DK)

( * ) Notice: Subject to any disclaimer, the term of this patent is extended or adjusted under 35 U.S.C. 154(b) by 0 days.

(21) Appl. No.: 15/035,421

(22) PCT Filed: Nov. 13, 2014

(86) PCT No.: PCT/IB2014/066026

§ 371 (c)(1),
(2) Date: May 9, 2016

(87) PCT Pub. No.: WO2015/071860

PCT Pub. Date: May 21, 2015

(65) Prior Publication Data

US 2016/0296942 A1 Oct. 13, 2016

Related U.S. Application Data

(60) Provisional application No. 61/904,033, filed on Nov. 14, 2013.

(51) Int. Cl.
*B03B 5/66* (2006.01)
*B03B 5/62* (2006.01)

(52) U.S. Cl.
CPC ..... *B03B 5/623* (2013.01)

(58) Field of Classification Search
CPC ..... B03B 5/623; B03B 5/66; B07B 3/02
(Continued)

(56) References Cited

U.S. PATENT DOCUMENTS 3,333,692 A * 8/1967 Eveson ..... F26B 3/08 209/474
3,610,415 A 10/1971 Deak
(Continued)

FOREIGN PATENT DOCUMENTS

AU 758184 B2 8/2000
CN 101397606 B 4/2009

OTHER PUBLICATIONS

International Search Report and Written Opinion dated Feb. 10, 2015, 8 pages.

*Primary Examiner* — Terrell Matthews
(74) *Attorney, Agent, or Firm* — Matthew R. Weaver; Daniel DeJoseph; Jeffrey A. Sharp

(57) ABSTRACT

A classifier and a method of separating material using such a classifier are disclosed. The classifier comprises a mixing chamber having a mixing fluidization floor and a concentration chamber having a concentration fluidization floor. The concentration fluidization floor and at least a portion of the concentration chamber is located below the mixing fluidization floor. The method of separating material using such a classifier comprises delivering material to be separated into a mixing chamber of the classifier, fluidizing the material in the mixing chamber; transferring some of the material to a concentration chamber of the classifier in fluid communication with the mixing chamber, fluidizing the material in the concentration chamber, forming a concentrating fluidized bed in the concentration chamber, separating the material with at least the concentrating fluidized bed and drawing heavier portions of the separated material from the concentration chamber.

5 Claims, 5 Drawing Sheets

(58) Field of Classification Search
USPC ..... 209/155, 158, 159
See application file for complete search history.

(56) References Cited

U.S. PATENT DOCUMENTS 4,589,981 A * 5/1986 Barari ..... B03B 5/623
209/474
6,030,432 A * 2/2000 Kepplinger ..... C21B 13/0033
266/144
6,264,040 B1 * 7/2001 Mankosa ..... B03B 11/00
209/155
6,425,485 B1 * 7/2002 Mankosa ..... B03B 5/623
209/158
6,814,241 B1 * 11/2004 Galvin ..... B01J 8/22
209/158
9,415,397 B1 * 8/2016 Christodoulou ..... B03B 5/623

* cited by examiner

CLASSIFIER

FIELD OF THE INVENTION

The invention relates to a classifier. In particular, although not exclusively, the invention relates to a concentrating Reflux™ classifier for separation of materials, such as ore particles, in mining and mineral processing.

BACKGROUND TO THE INVENTION

The classification of particles according to their size and/or weight is often used in mineral processing. In order to classify these particles it is common to locate the particles in a solution to form a slurry. This slurry is then passed through various types of equipment in order to separate the particles into different sizes and/or densities.

One of these types of equipment is a classifier that separates particles according to their size and/or density. Reflux classifiers typically have a slurry which is fluidised and passed through a plurality of parallel plates, or lamellae, which use gravity to separate solid particles from the liquid. In order to operate the Reflux classifier needs the material being separated to form a fluidised bed, which is the primary form of gravity separation.

However, for low grade minerals, typically high value minerals such as gold or diamonds where head grades are in the order of a few percent or lower, only a relatively small portion of the feed material results in underflow. This results in the Reflux classifier having difficulty forming an effective fluidised bed. In some cases it can take many hours to form a bed and, during this time, no effective separation or concentration occurs, resulting in lost productivity. Furthermore, even once a fluidised bed is achieved, the mineral concentrations are so low that they typically need to be processed multiple times to yield the desired mineral output. This complicates processing, further increasing capital and running costs and further reducing efficiency.

It will be clearly understood that any reference herein to background material or information, or to a prior publication, does not constitute an admission that any material, information or publication forms part of the common general knowledge in the art, or is otherwise admissible prior art, whether in Australia or in any other country.

OBJECT OF THE INVENTION

It is an object of the invention to overcome or at least alleviate one or more of the above problems and/or provide the consumer with a useful or commercial choice.

Other preferred objects of the present invention will become apparent from the following description.

Disclosure of the Invention

In one form, although it need not be the only or indeed the broadest form, the invention resides in a classifier comprising:

- a mixing chamber having a mixing fluidisation floor; and
- a concentration chamber having a concentration fluidisation floor;
- wherein the concentration fluidisation floor and at least a portion of the concentration chamber is located below the mixing fluidisation floor.

Preferably the concentration chamber is smaller in volume than the mixing chamber and preferably the concentration fluidisation floor is smaller in area than the mixing fluidisation floor. Preferably the concentration chamber has a smaller horizontal cross-sectional area than the mixing chamber.

Preferably the concentration chamber has a cross-sectional area that is at least half that of the mixing chamber; even more preferably at least an order of magnitude smaller than the cross-sectional area of the mixing chamber; even more preferably approximately 20 to 200 times smaller than the cross-sectional area of the mixing chamber.

Preferably the fluidisation floors are substantially conical or frustoconical. Preferably the fluidisation floors have a plurality of nozzles adapted to release fluid into their respective chambers, with the concentration fluidisation floor preferably having less nozzles than the mixing fluidisation floor.

Preferably each fluidisation floor has a fluidisation chamber located underneath. Preferably a mixing fluidisation chamber located underneath the mixing fluidisation floor is in fluid communication with the mixing chamber via mixing chamber nozzles and preferably a concentration fluidisation chamber located underneath the concentration fluidisation floor is in fluid communication with the concentration chamber via concentration chamber nozzles.

Preferably the concentration chamber is located substantially below the mixing fluidisation floor of the mixing chamber. Preferably the concentration chamber is located centrally with respect to the mixing chamber and/or the mixing fluidisation floor of the mixing chamber. Preferably the concentration chamber has one or more pressure sensors. Preferably the concentration chamber has at least two pressure sensors located longitudinally between the mixing fluidisation floor and the concentration fluidisation floor.

Preferably the concentration chamber is substantially elongated, preferably substantially cylindrical in shape. Preferably the concentration fluidisation floor is located at an opposite end of the concentration chamber to an end of the concentration chamber located adjacent to the mixing chamber and/or mixing fluidisation floor. Preferably the concentration chamber extends downward from an apex region of the mixing fluidisation floor.

Preferably the concentration chamber has an outlet which is preferably an underflow valve. Preferably the underflow valve is located adjacent the concentration fluidisation floor. Preferably the underflow valve is located centrally with respect to the concentration fluidisation floor. Preferably the underflow valve is configured to draw material from the concentration chamber.

Preferably the classifier further comprises a separation chamber located above the mixing chamber to separate solids from slurry. Preferably the separation chamber is configured to release solids from slurry under gravity such that they fall back into the mixing chamber. Preferably the separation chamber may have at least one de-aeration chamber and/or at least one launder. Preferably the separation chamber comprises a series of plate arrays. Preferably the plate arrays comprise a plurality of parallel plates. Preferably the plurality of parallel plates are inclined.

In another form, the invention resides in a method of separating material comprising:

- delivering material to be separated into a mixing chamber;
- fluidising the material in the mixing chamber;
- transferring some of the material to a concentration chamber in fluid communication with the mixing chamber;
- fluidising the material in the concentration chamber;
- forming a concentrating fluidised bed in the concentration chamber;

separating the material with at least the concentration fluidised bed; and drawing heavier portions of the separated material from the concentration chamber.

Preferably the method further comprises the step of forming a mixing fluidised bed in the mixing chamber. Preferably the step of drawing heavier portions of the separated material comprises monitoring pressure in at least the concentration chamber to maintain the concentrating fluidised bed.

Preferably the method further comprises de-aerating the material to be separated. Preferably the method further comprises the step of forcing material through a separation chamber and drawing lighter portions of the separated material from the separation chamber.

Further features of the present invention will become apparent from the following detailed description.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, wherein.

DETAILED DESCRIPTION OF THE INVENTION

FIGS. 1 to 5 illustrate a classifier in the form of a Reflux classifier 100 used to separate material on the basis of size and weight. The Reflux classifier 100 has a mixing chamber 120 located above a concentration chamber 140 and below a separation chamber in the form of a lamella chamber 160.

Figure 1:
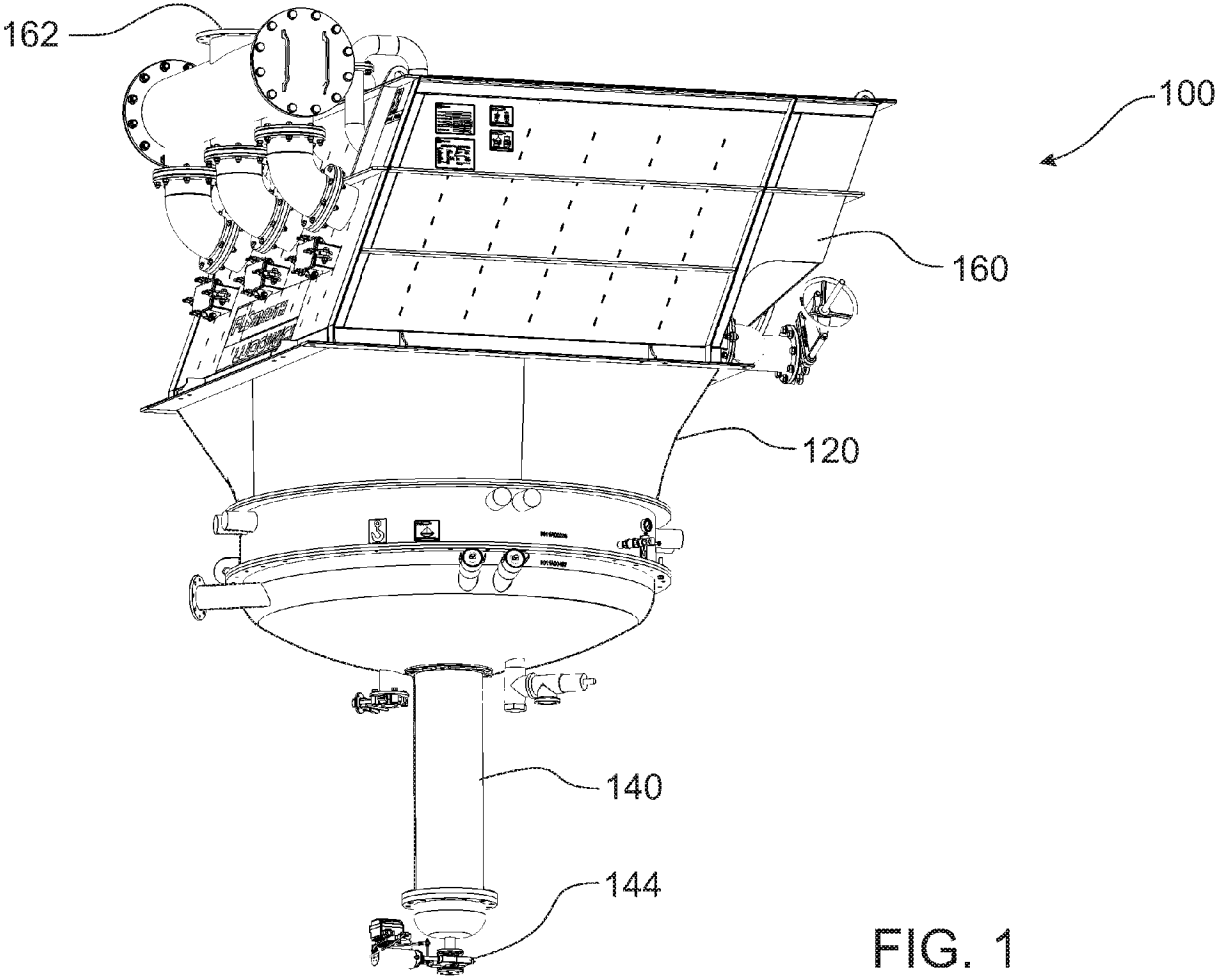
FIG. 1 is a side perspective view of a classifier according to an embodiment of the invention.
Figure 2:
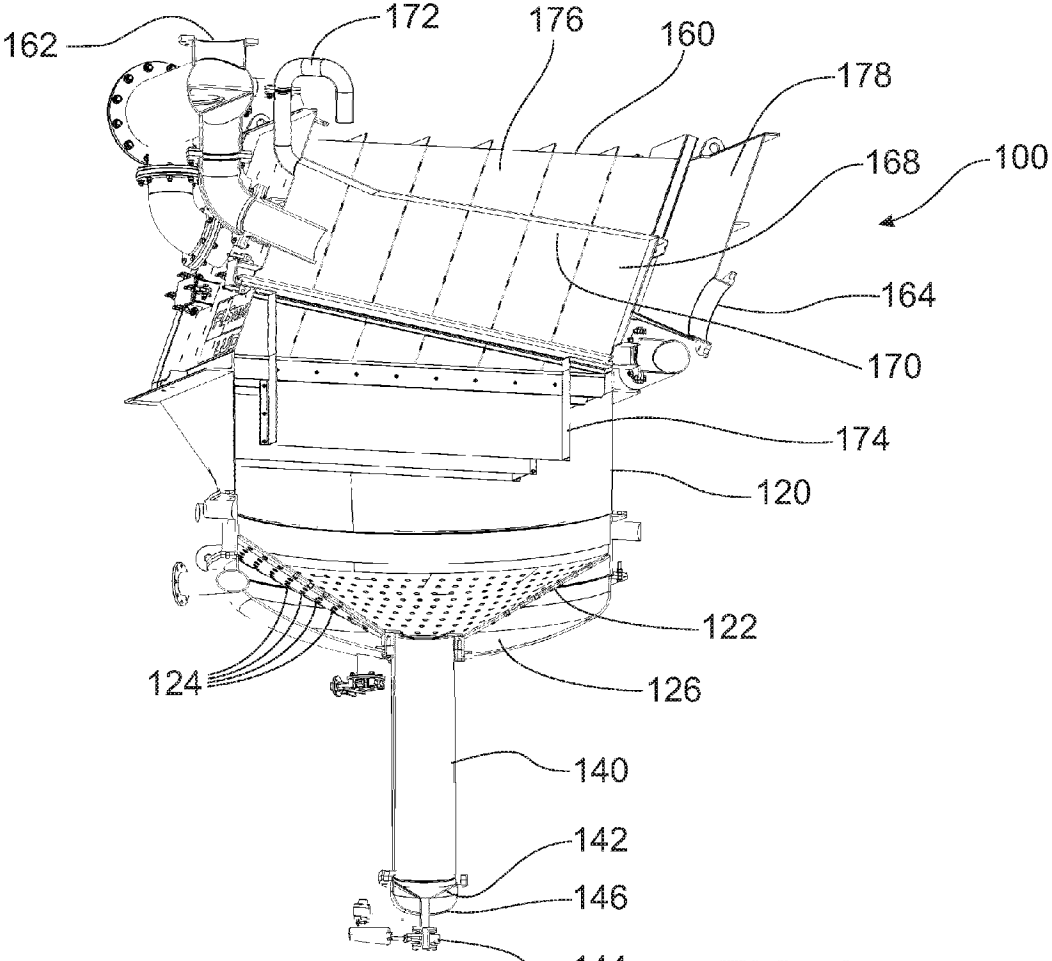
FIG. 2 is a cross-sectional view of FIG. 1.
Figure 3:
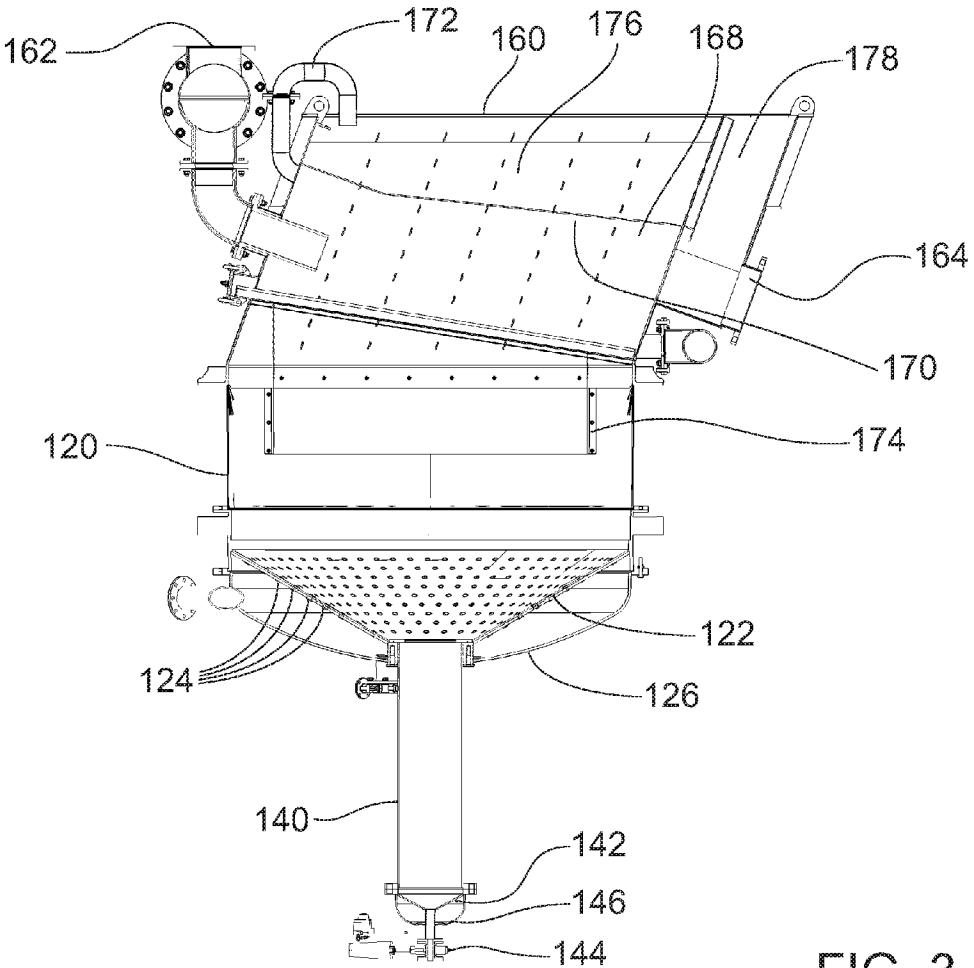
FIG. 3 is a side elevation cross-sectional view of the classifier illustrated in FIG. 1.

As illustrated most clearly in FIGS. 2 and 3 which show cross-sectional views of the classifier 100, the mixing chamber 120 has a mixing fluidisation floor 122 and the concentration chamber 140 has a concentration fluidisation floor 142. The fluidisation floors 122 and 142 are both generally conical in shape with a plurality of nozzles 124 (not shown in concentration fluidisation floor 142).

The concentration chamber 140 is located centrally at the apex of the mixing fluidisation floor 122 and extends downwardly below the mixing fluidisation floor 122 and mixing chamber 120 to the concentration fluidisation floor 142 and material outlet in the form of an underflow valve 144. The underflow valve 144 is in fluid communication with the concentration chamber 140 and can be actuated to selectively allow material to pass therethrough.

Figure 4:
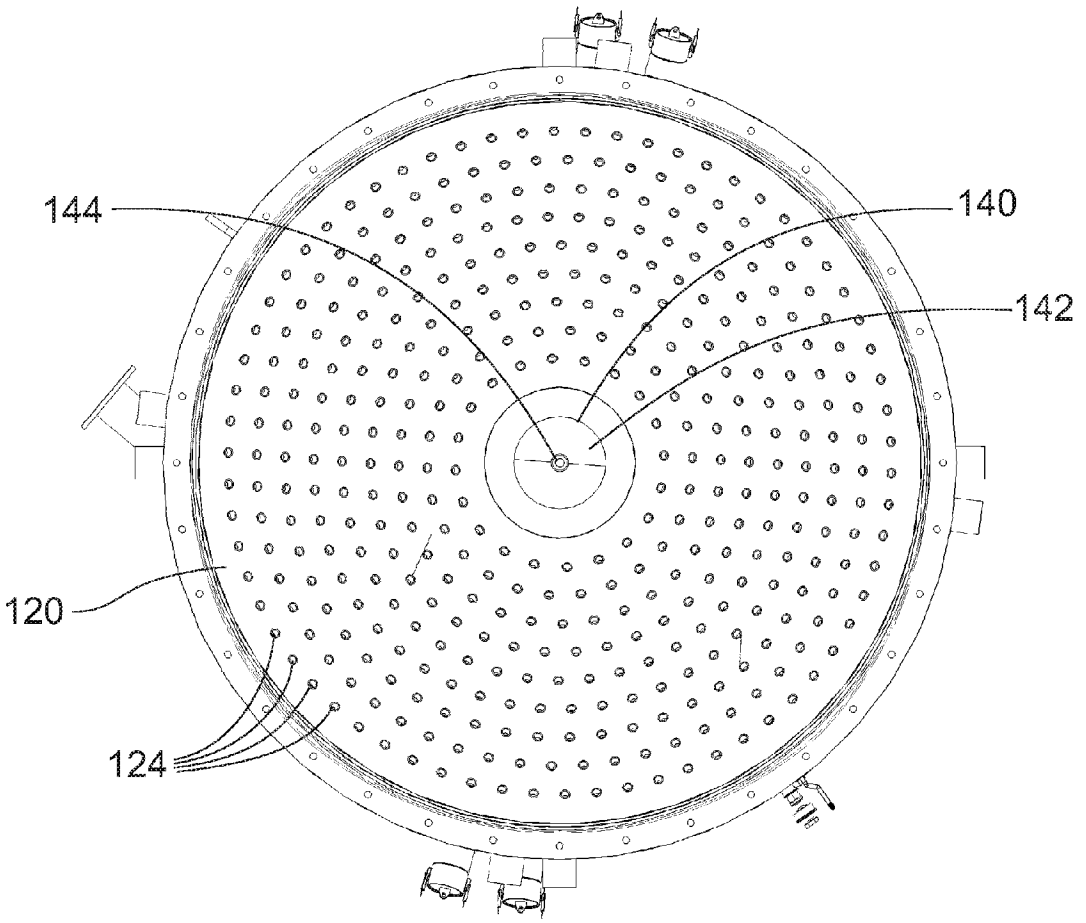
FIG. 4 is a top plan cross-sectional view of the classifier illustrated in FIG. 1.
Figure 5:
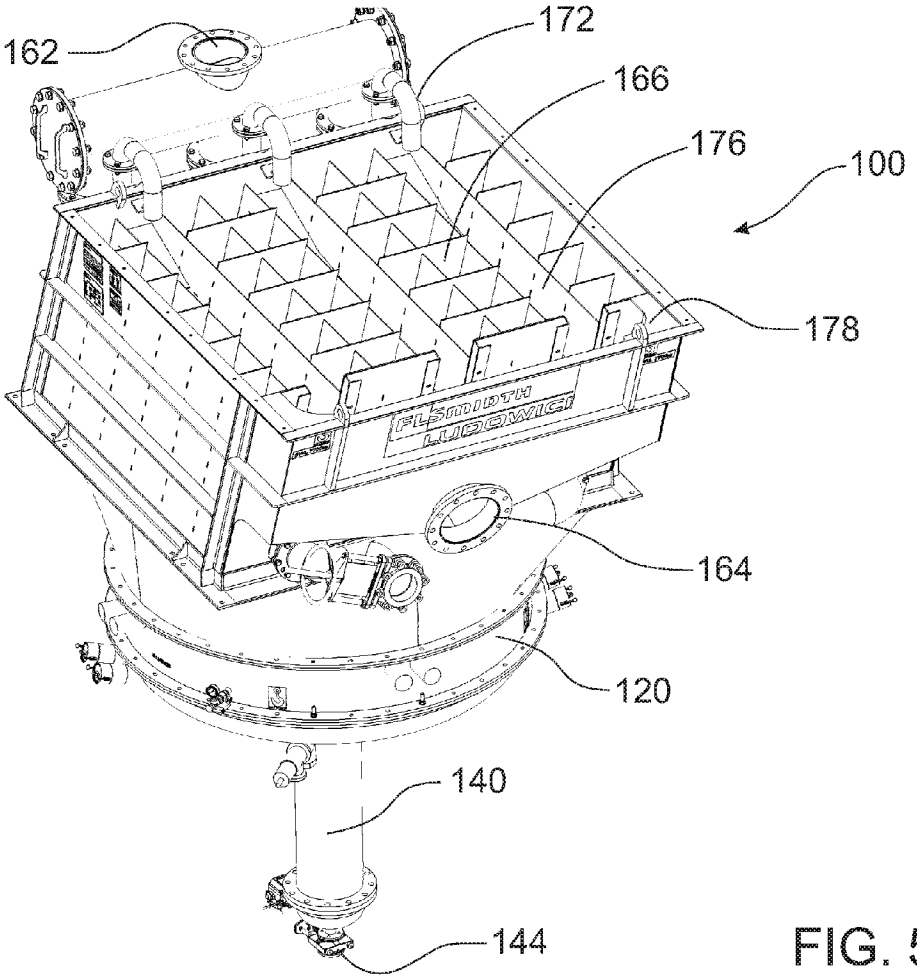
FIG. 5 is a top perspective view of the classifier illustrated in FIG. 1.

The concentration chamber 140 is considerably smaller than the mixing chamber 120, most notably in cross-sectional area across the horizontal axis (i.e. perpendicularly to the force of gravity) as most clearly illustrated in FIG. 4. In preferred embodiments the horizontal cross-sectional area of the concentration chamber 140 is 20 to 200 times smaller than the horizontal cross-sectional area of the mixing chamber 120. The concentration fluidisation floor 142 is consequently also smaller than the mixing fluidisation floor 122.

The concentration chamber 140 is elongate in the form of a cylinder with the mixing fluidisation floor 122 and the concentration fluidisation floor 142 located at adjacent ends along a longitudinal axis of the concentration chamber 140. Both the mixing fluidisation floor 122 and the concentration fluidisation floor 142 have central openings, with the mixing fluidisation floor 122 having the concentration chamber 140 located in its central opening and the concentration fluidisation floor 142 having the underflow valve 144 located in its central opening.

The mixing chamber 120 has a fluidisation chamber 126 located below its fluidisation floor 122 and the concentration chamber 140 similarly has a fluidisation chamber 146 located below its fluidisation floor 142. The fluidisation chambers 126 and 146 are fluidly communicated to their respective mixing chamber 120 and concentration chamber 140 via their respective nozzles in the mixing fluidisation floor 122 and the concentration fluidisation floor 142.

The lamella chamber 160, which is located directly above the mixing chamber 120, has an inlet 162 and an outlet 164. As seen most clearly in FIG. 5 which shows the classifier 100 with its top (not shown) removed, the lamella chamber 160 has a series of plate arrays 166. The plate arrays 166 have parallel plates that are inclined relative to the axis of gravity to provide a classifying effect to material that passes through the plate arrays 166.

The inlet 162 is fluidly connected to a plurality of inlet chambers 168 which may have an inclined de-aeration ceiling 170 that urges lighter air particles upwards toward a de-aeration pipe 172. Each inlet chamber 168 is fluidly connected to the mixing chamber 120, via optional chutes 174 that extend into the mixing chamber 120, allowing slurry from the inlet chambers 168 to make its way to the mixing chamber 120 for processing.

A plurality of launders 176 are provided in the lamella chamber 160 to catch particles located within the slurry after it has passed through the plate arrays 166. The launders 176 are fluidly connected to an outlet chamber 178 which is in turn fluidly connected to the outlet 164. The de-aeration pipes 172 which may be present are fluidly connected from the inlet chamber 168 directly to the launders 176 to allow lighter air particles to bypass the mixing chamber 120 and plate arrays 166.

In use, the Reflux classifier 100 receives material to be separated as slurry into inlet 162 where it is processed by the Reflux classifier 100. Specifically, the material to be processed is passed from inlet 162 to inlet chamber 168 where it may be de-aerated as any air in the material rises and is urged toward de-aeration pipe 172, by inclined de-aeration ceiling 170 of the inlet chamber 168. The air passes through de-aeration pipe 172 to the launders 176.

From the inlet chamber 168 the material then travels down chutes 174 to the mixing chamber 120 located below the lamella chamber 160. The majority of the slurry is then mixed and fluidised by the fluidising mixing fluidisation floor 122 of the mixing chamber 120 and a minority portion, typically comprising heavier portions of the material to be separated, passes to the concentration chamber 140 where it is fluidised by the concentration fluidisation floor 142.

A concentrating fluidised bed is formed in the concentrating chamber 140 and a mixing fluidised bed is formed in the mixing chamber 120. Heavier materials are concentrated by the concentrating fluidised bed which, when appropriate, can be drawn from the underflow valve 144. The mixing fluidised bed assists in flushing light materials to overflow via lamella chamber 160 and outlet 164.

Generally lighter materials pass upwardly through the lamella chamber 160 where any heavier particles are dropped into the mixing chamber 120 and/or the concentration chamber 140 by the parallel plates 166. The lighter and smaller particles are able to pass through the plates 166 where they pass into the launders 176, into the outlet chamber 178 and out of the outlet 164.

Advantageously, the Reflux classifier 100 can effectively separate materials with low grades. The concentration chamber 140 can quickly and efficiently form a concentrating bed over its reduced surface area, relative to the mixing chamber 120. This not only enables fast operation with minimal time delay waiting for an adequate fluidised bed to form, but also provides a more efficient concentrating operation that yields a very high grade output, from the underflow valve 144, that requires minimal, if any, further processing. The Reflux classifier 100 therefore realises significant increase in productivity as well as a reduction in operating and capital costs.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In the present specification and claims (if any), the word "comprising" and its derivatives including "comprises" and "comprise" include each of the stated integers but does not exclude the inclusion of one or more further integers unless the context of use indicates otherwise.

The invention claimed is:

1. A classifier comprising: a mixing chamber having a mixing fluidization floor; and a concentration chamber having a concentration fluidization floor; wherein the concentration fluidization floor and at least a portion of the concentration chamber is located below the mixing fluidization floor; and wherein the concentration chamber, is substantially elongated and wherein the concentration chamber extends downward from an apex region of the mixing fluidization floor; and wherein the concentration chamber has a horizontal cross-sectional area that is 20 to 200 times smaller than the horizontal cross-sectional area of the mixing chamber.

2. The classifier of claim 1, wherein the concentration chamber, having an end adjacent to the mixing fluidization floor, is substantially elongated and the concentration fluidisation floor is located at an opposite end of the concentration chamber to the end located adjacent the mixing fluidisation floor.

3. The classifier of claim 1, wherein the concentration chamber has an outlet and at least two pressure sensors located longitudinally between the mixing fluidisation floor and the concentration fluidisation floor.

4. The classifier of claim 1 wherein a separation chamber is positioned above the mixing chamber.

5. The classifier of claim 4 wherein at least one launder is positioned within the separation chamber.

* * * * *